US006762544B2

(12) United States Patent
Kim et al.

(10) Patent No.: US 6,762,544 B2
(45) Date of Patent: Jul. 13, 2004

(54) METAL CATHODE FOR ELECTRON TUBE

(75) Inventors: Yoon-chang Kim, Kyungki-do (KR); Kyu-nam Joo, Seoul (KR); Dong-kyun Seo, Kyungki-do (KR); Bu-chul Sin, Seoul (KR)

(73) Assignee: Samsung SDI Co., Ltd., Kyungki-do (KR)

( * ) Notice: Subject to any disclaimer, the term of this patent is extended or adjusted under 35 U.S.C. 154(b) by 67 days.

(21) Appl. No.: 09/950,777

(22) Filed: Sep. 13, 2001

(65) Prior Publication Data

US 2002/0101146 A1 Aug. 1, 2002

(30) Foreign Application Priority Data

Jan. 29, 2001 (KR) ..... 2001-4033

(51) Int. Cl.[7] ..... H01J 1/20; H01J 19/14

(52) U.S. Cl. ..... 313/346 DC; 313/346 R; 313/270; 313/337

(58) Field of Search ..... 313/346 DC, 270, 313/446, 451, 450, 337, 37, 311, 336, 346 R, 15

(56) References Cited

U.S. PATENT DOCUMENTS 4,910,079 A * 3/1990 Shroff et al. ..... 428/306.6
5,444,327 A * 8/1995 Treseder et al. ..... 313/337
6,255,764 B1 * 7/2001 Choi et al. ..... 313/346 R

* cited by examiner

*Primary Examiner*—Ashok Patel
(74) *Attorney, Agent, or Firm*—Leydig, Voit & Mayer, Ltd.

(57) ABSTRACT

An indirectly heated metal cathode for an electron tube includes a metal sleeve of an Mo material, a metal emitter disposed on the metal sleeve and including Pt or Pd as a main component; and a buffer layer between the metal sleeve and the metal emitter. The buffer layer prevents Mo, an element of the metal sleeve, from diffusing into the emitter during the operation of the metal cathode so that electron-emitting performance does not decrease rapidly with operating time due to an increase in a work function. Therefore, the metal cathode satisfies a long life span requirement for large scale and high definition electron tubes.

20 Claims, 2 Drawing Sheets

METAL CATHODE FOR ELECTRON TUBE

BACKGROUND OF THE INVENTION

1. Field of the Invention

The present invention relates to a metal cathode for an electron tube, and more particularly, to a thermoelectron emissive metal cathode which has high electron-emitting performance and a life span sufficiently improved for use in electron tubes, such as Braun tubes, camera tubes, and high frequency magnetron tubes.

2. Description of the Related Art

A conventional thermoelectron emissive cathode for an electron tube uses an oxide cathode. The oxide cathode includes an electron emissive oxide layer obtained by conversion of a ternary or binary carbonate, preferably (Ba, Sr, Ca)$CO_3$ or (Ba, Sr)$CO_3$ disposed on a base metal, mainly composed of Ni, with a slight amount of a reducing agent, such as Mg and Si. Since such an oxide cathode has a low work function, it has an advantage of relatively low operating temperature (700–800° C.). However, since the electron-emitting performance of the oxide cathode is limited, it is difficult to provide a current density exceeding 1 A/$cm^2$. When electron emission density is increased, the raw material is evaporated or melted due to Joule heating and the cathode deteriorates, since the oxide cathode is a semiconductor, and develops a large electrical resistance. Moreover, a resistive layer may be formed between the metal base and the oxide layer due to prolonged operation, which shortens the life span of the cathode.

In addition, since an oxide cathode is fragile and has poor adhesion to a base metal on which the oxide cathode is mounted, the life span of a cathode-ray device using the cathode is limited. For example, when only one of the three oxide cathodes of a color cathode-ray tube fails, the expensive device must be replaced.

Therefore, attempts to produce a high performance metal cathode, without the drawbacks of an oxide cathode, for use in a cathode-ray device have been made, but have met with only limited success.

FIG. 1 shows a conventional structure of a metal cathode. The metal cathode includes-an emitter 11 for emitting electrons and that is bonded to a sleeve 12 by laser welding or diffusion bonding. Since the metal cathode operates at a high temperature, 1100° C. or higher, the sleeve 12 is usually Mo which has excellent mechanical and chemical characteristics at high temperature. However, the Mo of the sleeve 12 diffuses and moves to the surface of the emitter 11 during the operation of the metal cathode. As the amount of Mo on the surface of the emitter 11 increases, the work function (2.2 eV) of the metal cathode continuously increases due to the high work function of Mo. Consequently, the electron-emitting performance declines and life span of the cathode is shortened.

To overcome these problems of oxide cathodes and metal cathodes, various types of metal cathodes have been proposed. For example, it is known that a metal cathode based on lanthanum hexaboride ($LaB_6$) has better strength and higher electron-emitting performance than an oxide cathode. A single crystal cathode of hexaboride can provide high current density, up to 10 A/$cm^2$. However, since the life span of an $LaB_6$ cathode is short, the $LaB_6$ cathode has been used for vacuum electronic devices in which a cathode unit can be conveniently replaced. The short life span of an $LaB_6$ cathode is caused by its high reactivity with the components of a heater. For example, when $LaB_6$ contacts a W heater, a fragile compound is formed as a result of a chemical reaction.

U.S. Pat. No. 4,137,476 discloses a cathode including a barrier material between $LaB_6$ and the body of a heater in order to remove the possibility of a reaction. However, the manufacturing cost of this structure is considerably increased over the $LaB_6$ cathode, without a considerable improvement in the life span of the cathode.

USSR Patent No. 970,159 discloses a metal cathode formed by adding an alkaline earth metal to the main element, chosen from the platinum group of metals, improving the thermoelectron emissive characteristic and raising the secondary electron emission coefficient.

USSR Patent No. 1,365,948 discloses a metal cathode formed by adding a refractory metal to a metal alloy cathode, including an element of the platinum group metals and an alkaline earth metal, improving electron-emitting performance, improving shape stability and processibility at high temperature, and reducing cost.

In USSR Patent No. 1,975,520, an alkaline metal is added to a metal alloy including an element of the platinum group metals and an alkaline earth metal in order to decrease the operating temperature of the metal alloy and to raise the secondary electron emission coefficient.

However, none of these patents discloses a way to overcome the problem of diffusion of Mo into an emitter of a metal cathode.

SUMMARY OF THE INVENTION

To solve the above problems, it is an object of the present invention to provide a metal cathode in which the Mo component of a sleeve is prevented from diffusing into an emitter in order to avoid an increase in work function so that the metal cathode has better electron-emitting performance and a longer life span than an existing oxide cathode or metal cathode for a large scale and high definition electron tube.

Accordingly, to achieve the above object of the invention, there is provided an indirectly heated metal cathode for an electron tube, comprising a metal sleeve including Mo; a metal emitter disposed on the sleeve, the metal emitter containing at least one of Pt and Pd as a main component; and a buffer layer between the metal sleeve and the metal emitter. The sleeve is preferably an Mo—Re alloy. The metal emitter is preferably an alloy comprising 85 to 99.5% by weight of at least one of Pt and Pd and 0.5 to 15% by weight of at least one of Ba, Ca, and Sr.

Preferably the buffer layer comprises at least one element selected from the group consisting of W, Hf, Ir, Ru, Zr, Nb, V, and Rh, more preferably Hf or W. The thickness of the buffer layer is 0.5–100 $\mu$m, preferably 0.5–20 $\mu$m, more preferably 3–10 $\mu$m, and most preferably 5 $\mu$m.

In addition, the area of the buffer layer may be the same as that of the metal emitter.

BRIEF DESCRIPTION OF THE DRAWINGS

The objectives and advantages of the present invention will become more apparent from the following description of a preferred embodiment with reference to the attached drawings in which.

DETAILED DESCRIPTION OF THE PRESENT INVENTION

Figure 1:
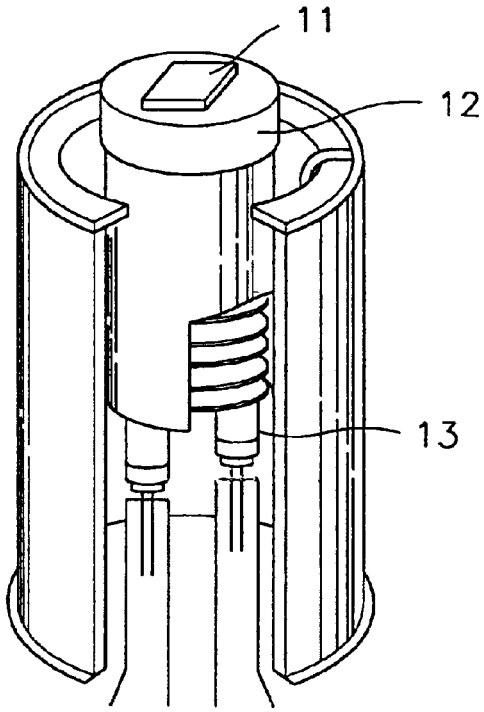
FIG. 1 is a partially cutaway view of a metal cathode structure.
Figure 2:
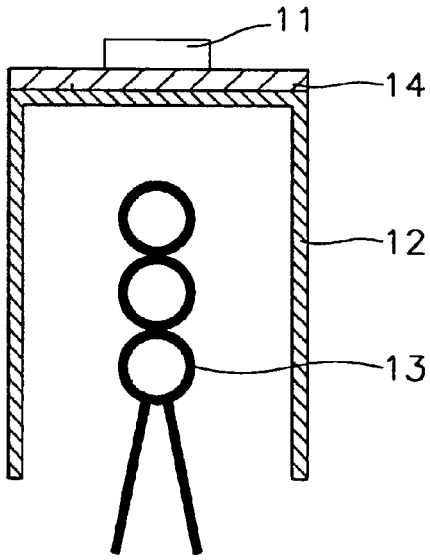
FIG. 2 is a schematic cross-sectional diagram of a metal cathode according to the present invention.

A metal cathode and a method of manufacturing the metal cathode according to the present invention are now described in detail. The present invention relates to an indirectly heated metal cathode having improved electron-emitting performance and life span. The metal cathode includes a buffer layer, preferably a thin layer, between a sleeve and a metal emitter in a metal cathode assembly. Preferably, the buffer layer comprises a refractory metal preventing Mo, an element of the sleeve, from diffusing into the emitter.

In a metal cathode assembly according to the present invention, a metal emitter may include a binary or a multi-component material system, which includes an element of the platinum group metals, such as Pt or Pd, and an alkaline earth metal, such as Ba, Ca, or Sr. It is preferable that the metal emitter include 1 to 10% by weight of an alkaline earth metal. When the alkaline earth metal content is less than 1% by weight, problems of short life span and deficient electron emission occur due to a deficiency of the electron emitting source (Ba, Ca, or Sr). When the alkaline earth metal content is more than 10% by weight, an intermetallic compound is excessively produced, increasing the work function of the emitter.

In addition, since the basic concept of the present invention is to provide a buffer layer, that is, a diffusion barrier for preventing the Mo component of a sleeve from diffusing into an emitter by coating the surface of the sleeve with a thin layer of a third element, the element of the thin layer should satisfy the following conditions.

1. The thin layer should be a refractory metal element that can withstand the high operating temperature (1100° C. or higher) of the metal cathode.

2. The thin layer should not chemically react with the Mo sleeve or the metal emitter. Particularly, the thin layer should not form a solid solution with Pt or Pd, the main component of the emitter.

3. The thermal expansion coefficient of the thin layer should be similar to that of Mo so that the sleeve is not deformed during operation.

Among refractory metal elements, Hf satisfies all these conditions. Also, W, Ir, Ru, Zr, Nb, V, and Rh can improve the durability of a metal cathode, although not satisfying all these conditions. The melting point of each of these metals is 1800° C. or higher, and their thermal expansion coefficients are in a range of $4.5–7.3\times10^{-6}K^{-1}$, which is similar to Mo($4.8\times10^{-6}K^{-1}$).

It is preferable that the thickness of the buffer layer be 20 μm or less. As the layer becomes thicker, the efficiency in preventing a reaction with Mo increases. However, when the thickness of the layer is over 20 μm, the thermal efficiency of the cathode decreases, and the weldability to an emitter decreases.

A method of manufacturing a metal cathode according to the present invention is now described in detail.

An Mo sleeve 12 is cleaned and then installed in an RF sputtering apparatus using a jig. Next, the sleeve is coated with one element selected from the group consisting of W, Hf, Ir, Ru, Zr, Nb, V, and Rh by sputtering, to form a buffer layer 14. Besides RF sputtering, any layer forming method, such as thermal deposition, electron beam deposition, or DC deposition, can be used as the coating method.

As described above, it is preferable that the thickness of the coating layer be 20 μm or less. The thickness can be easily adjusted by controlling process variables such as sputtering power and deposition time.

The sleeve with the thin layer is subjected to heat treatment at a temperature of 1000–1300° C. in a vacuum or in a hydrogen ambient. By performing the heat treatment, the coating layer can be steadily fixed to the sleeve. In the case of sputtering, the grain growth produced by heating the layer decreases the diffusion of Mo.

An emitter 11 made through an alloying process is bonded by laser welding to the sleeve that is made as described above. Then, the remaining parts of the cathode are assembled using a conventional method of assembling a cathode to produce a metal cathode assembly. Thereafter, a Braun tube employing a metal cathode according to the present invention is completed using typical electron gun and electron tube manufacturing processes.

The present invention will be more fully described with reference to the following examples. However, the present invention is not restricted to these examples.

EXAMPLE 1

First, to manufacture a metal emitter, 94 g of Pt and 6 g of Ba were put in an arc furnace. Subsequently, the arc furnace evacuated. Ar gas was injected into the evacuated arc furnace. Next, a voltage was applied to the arc furnace, melting the Pt and Ba. The resulting ingot was subjected to the melting process three times in order to improve the chemical and micro-structural uniformity of the alloy. Finally, an alloy composed of 94.2% by weight Pt and 5.8% by weight Ba was produced. The ingot obtained through these processes was cut with a wire, completing the manufacture of a metal emitter 11.

An Mo sleeve 12 was cleaned and then mounted in an RF sputtering apparatus using a jig. The surface of the sleeve was coated with Hf to a thickness of 5 μm by RF sputtering. The sleeve 12 with the thin layer was heat treated at a temperature of 1300° C. in a hydrogen ambient for 20 minutes.

The metal emitter 11 was then bonded to the sleeve 12 by laser welding. The sleeve with the bonded emitter was mounted on a holder, and a heater 13 was inserted into the holder, completing manufacture of a metal cathode.

EXAMPLE 2

A metal cathode was manufactured in the same manner as in Example 1, with the exception that the surface of the sleeve was coated with W to a thickness of 5 μm.

EXAMPLE 3

A metal cathode was manufactured in the same manner as in Example 1, with the exception that the surface of the sleeve was coated with Hf to a thickness of 10 μm.

EXAMPLE 4

A metal cathode was manufactured in the same manner as in Example 1, with the exception that the surface of the sleeve was coated with W to a thickness of 10 μm.

EXAMPLE 5

A metal cathode was manufactured in the same manner as in Example 1, with the exception that the surface of the sleeve was coated with Hf to a thickness of 20 μm.

EXAMPLE 6

A metal cathode was manufactured in the same manner as in Example 1, with the exception that the surface of the sleeve was coated with Hf to a thickness of 30 μm.

COMPARISON EXAMPLE

A metal cathode was manufactured in the same manner as in Example 1, with the exception that a sleeve was not coated with any layer.

Figure 3:
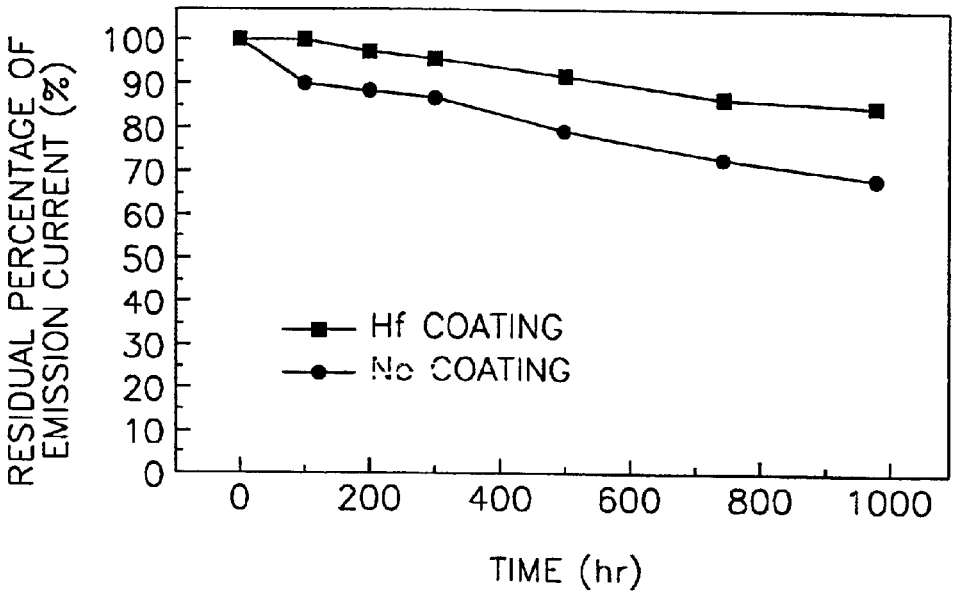
FIG. 3 is a graph of residual emission current of a metal cathode having an Hf coating layer on a sleeve and of a metal cathode not having an Hf coating layer, versus time.

FIG. 3 is a graph of residual emission current of a metal cathode from Example 1 and that of a metal cathode obtained from the Comparison Example, versus time. As is evident from FIG. 3, with a refractory metal coating which can prevent Mo, an element of the sleeve, from diffusing into the emitter, an increase in work function is suppressed and degradation of electron-emitting performance is reduced. Consequently, the life span of a metal cathode according to the present invention is improved by 15–20%.

In a metal cathode according to the present invention, a buffer layer, preferably a refractory metal layer, is located at the interface between the sleeve and the emitter so that Mo, an element of the sleeve, is prevented from diffusing into the emitter during operation of the metal cathode. As a result, the decrease in the electron-emitting performance is substantially reduced and the life span of the cathode is increased.

What is claimed is:

1. A metal cathode for an electron tube comprising:

a metal sleeve including Mo;

a metal electron emitter supported by and in thermal communication with the metal sleeve, the metal electron emitter containing at least one of Pt and Pd as a main component; and a diffusion barrier layer disposed between the metal sleeve and the metal electron emitter, preventing diffusion of Mo from the metal sleeve into the metal electron emitter.

2. The metal cathode of claim 1, wherein the metal sleeve includes an Mo—Re alloy.

3. The metal cathode of claim 1, wherein the metal electron emitter is an alloy comprising 85 to 99.5% by weight of at least one of Pt and Pd, and 0.5 to 15% by weight of at least one element selected from the group consisting of Ba, Ca, and Sr.

4. The metal cathode of claim 1, wherein the diffusion barrier layer comprises at least one element selected from the group consisting of W, Hf, Ir, Ru, Zr, Nb, V, and Rh.

5. The metal cathode of claim 1, wherein the diffusion barrier layer comprises at least one element selected from the group consisting of Hf and W.

6. The metal cathode of claim 1, wherein the diffusion barrier layer has a thickness of 0.5–100 μm.

7. The metal cathode of claim 1, wherein the diffusion barrier layer has a thickness of 0.5–20 μm.

8. The metal cathode of claim 1, wherein the diffusion barrier layer has a thickness of 3–10 μm.

9. The metal cathode of claim 1, wherein the diffusion barrier layer and the metal emitter have the same areas.

10. The metal cathode of claim 1, wherein the diffusion barrier layer is Hf.

11. A metal cathode for an electron tube comprising:

a metal sleeve including Mo;

a metal electron emitter supported by and in thermal communication with the metal sleeve, the metal electron emitter containing at least one of Pt and Pd as a main component and at least one element selected from the group consisting of Ba, Ca, and Sr, as a minor component; and a diffusion barrier layer disposed between the metal sleeve and the metal electron emitter, preventing diffusion of Mo from the metal sleeve into the metal electron emitter.

12. The metal cathode of claim 11, wherein the metal sleeve includes an Mo—Re alloy.

13. The metal cathode of claim 11, wherein the metal electron emitter is an alloy comprising 85 to 99.5% by weight of the at least one of Pt and Pd, and 0.5 to 15% by weight of the at least one element selected from the group consisting of Ba, Ca, and Sr.

14. The metal cathode of claim 11, wherein the diffusion barrier layer comprises at least one element selected from the group consisting of W, Hf, Ir, Ru, Zr, Nb, V, and Rh.

15. The metal cathode of claim 11, wherein the diffusion barrier layer comprises at least one element selected from the group consisting of Hf and W.

16. The metal cathode of claim 11, wherein the diffusion barrier layer has a thickness of 0.5–100 μm.

17. The metal cathode of claim 11, wherein the diffusion barrier layer has a thickness of 0.5–20 μm.

18. The metal cathode of claim 11, wherein the diffusion barrier layer has a thickness of 3–10 μm.

19. The metal cathode of claim 11, wherein the diffusion barrier layer and the metal emitter have the same areas.

20. The metal cathode of claim 11, wherein the diffusion barrier layer is Hf.

* * * * *